United States Patent [19]

Frank

[11] 4,069,748

[45] Jan. 24, 1978

[54] METHOD OF FORMING A NOZZLE OUTLET IN THE STRETCHABLE FLEXIBLE WALL FOR A CONTAINER

[75] Inventor: Carl A. Frank, River Vale, N.J.

[73] Assignees: Claire D. Frank; Gerald A. Frank; G. Kendall Parmelee

[21] Appl. No.: 742,451

[22] Filed: Nov. 17, 1976

Related U.S. Application Data

[62] Division of Ser. No. 633,618, Nov. 20, 1975, Pat. No. 4,017,020.

[51] Int. Cl.[2] ..... B31B 49/04

[52] U.S. Cl. ..... 93/35 R; 93/8 VB; 93/8 WA

[58] Field of Search ..... 93/8 VB, 8 WA, 8 R, 93/36 DA, 35 R; 229/62; 222/541; 150/8

[56] References Cited

U.S. PATENT DOCUMENTS

| | | | |
|---|---|---|---|
| 1,368,545 | 2/1921 | Childers | 24/30.5 R |
| 2,443,335 | 6/1948 | Vogel | 24/30.5 R X |
| 2,779,554 | 1/1957 | Kizzek | 150/8 X |
| 3,069,303 | 12/1962 | Scholle | 93/8 WA X |
| 3,182,365 | 5/1965 | Crawford et al. | 24/30.5 L |
| 3,389,643 | 6/1968 | Lemcke et al. | 93/8 WA |
| 3,448,889 | 6/1969 | Malpas | 222/541 X |
| 3,642,172 | 2/1972 | Malpas | 222/541 X |
| 3,783,920 | 1/1974 | Weikert | 150/8 |

*Primary Examiner*—James F. Coan
*Attorney, Agent, or Firm*—Parmelee, Johnson & Bollinger

[57] ABSTRACT

A method of forming a nozzle outlet in the stretchable, flexible wall for a container by providing rigid inner and outer sleeves adapted to mate together in taper-interlocked relationship by stretching a portion of the wall around the inner sleeve and becoming sandwiched between the mated sleeves. The inner sleeve has an outlet passage extending therethrough and has an exterior surface which tapers at a small angle, the outer sleeve having an interior surface tapering at a corresponding angle so the sleeves will engage together in a wedging-locking relationship with the stretched wall portion sandwiched and protected between them.

2 Claims, 6 Drawing Figures

METHOD OF FORMING A NOZZLE OUTLET IN THE STRETCHABLE FLEXIBLE WALL FOR A CONTAINER

This application is a division of application Ser. No. 633,618, filed Nov. 20, 1975, and now issued as U.S. Pat. No. 4,017,020, dated Apr. 12, 1977.

FIELD OF THE INVENTION

The present invention is in the field of packaging and more particularly relates to a nozzle outlet formed in the stretchable wall of a container.

BACKGROUND OF THE INVENTION

Stretchable, flexible material has been used for many years to form containers. For example, in the 1940's oleomargarine was packaged in bags made of polyethylene. In some cases, the user squeezed and manipulated the bag to rupture a color capsule and kneaded the bag to disperse the color throughout the margarine content. To disperse the contents, the user would cut or tear off a corner of the bag.

More recently, milk and other liquids have been packaged in polyethylene bags for the household commercial market. Again, the user cut or tore a corner off of the bag when the user wished to dispense the contents. There was no provision for reclosure of the cut or torn corner of the bag.

Large polyethylene bags up to five gallons have been used for the commercial institutional market, such as hospitals, luncheonettes, etc. In these larger bags, a flexible hose was sealed into the bag with the outer end of the hose sealed closed. The whole bag was loaded into a dispenser with the hose extending through a pinch valve. The sealed outer end of the hose protruded from the dispenser valve so that the user could cut off the sealed end of the hose. Thus, the bag was reclosed by pinching the hose flat using the mechanical valve mechanism of the dispenser. There was no way to reclose such a large bag by itself after the sealed end of the hose was cut off.

For some years, intravenous liquids for hospital use have been packaged in polyvinyl chloride bags using tubes sealed into the bags with the outer ends of the tubes being sealed off. The sealed ends of these tubes are cut off to dispense the intravenous liquids and also to provide access for adding medicinal substances to the liquid content. More recently, such intravenous bags have been made with additive ports and with administrative ports which are sealed into the side wall of the bag.

For many years there has been a long felt need for a practical inexpensive nozzle outlet in stretchable, flexible container walls. It has been proposed to provide a nozzle outlet in the plastic film wall of the container by using an elongated rigid inner sleeve having a ridge extending around the exterior of the sleeve approximately midway between the ends of this elongated sleeve. A rigid outer member providing an inwardly projecting rounded shoulder having a smaller internal diameter (I.D.) than the external diameter (O.D.) of the ridge is forced over the peak of this ridge for clamping a very narrow portion, essentially a line contact portion, of the plastic film between the inner sleeve and the outer member at a position located beyond the peak of the ridge. This outer member may take the shape of a rigid O-ring, and thus the inwardly projecting rounded shoulder is provided by the inner surface of the O-ring.

Thus, it is seen that only a very narrow localized portion, essentially a line contact portion, of the plastic film is clamped beneath the O-ring, which causes a stress concentration in the plastic film with a resultant weakening of the plastic film wall at the nozzle outlet. In addition, there is a severe stress concentration and shearing cutting action which occurs as the rounded shoulder of the outer member is forced over the peak of the ridge on the inner sleeve. Tearing of the plastic film wall sometimes occurs as this rounded shoulder is forced over the peak of the ridge. Sometimes induced stresses in the plasic film wall are so great that it spontaneously tears itself subsequent to installation.

The present invention advantageously overcomes all of these problems of the prior art and advantageously provides an inexpensive, practical nozzle outlet in a stretchable, flexible wall for a container.

SUMMARY OF THE INVENTION

In accordance with the invention, a nozzle outlet in the stretchable, flexible wall for a container is provided by inner and outer sleeves mated together in wedging-locking relationship with a stretched portion of the wall material sandwiched between them. The inner sleeve has an outlet passage extending therethrough and has an exterior tapered surface which converges at a small angle toward one end, while the outer sleeve has an interior tapered surface which diverges at a small angle toward one end. The small angle of taper of this exterior and interior surface is the same, so that they will engage together in a wedging-locking relationship with a stretched portion of the wall material sandwiched, supported and protected between the wedgingly interlocked tapered surfaces, thereby firmly securing the nozzle outlet in place.

BRIEF DESCRIPTION OF THE DRAWINGS

The various features, aspects and advantages of the present invention will be more fully understood from a consideration of the following description in conjunction with the accompanying drawings, in which.

DETAILED DESCRIPTION

Figure 1:
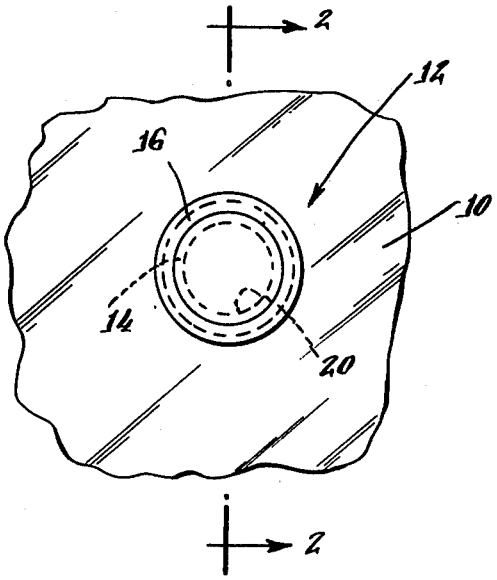
FIG. 1 is an elevational view of a nozzle outlet in a stretchable wall for a container embodying the present invention.
Figure 2:
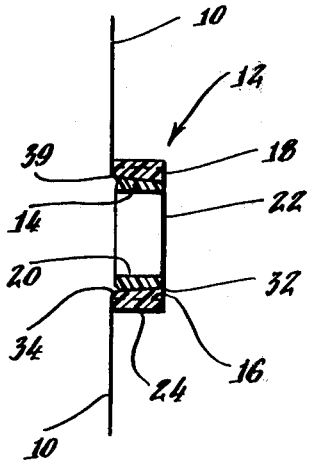
FIG. 2 is a cross-sectional view of the nozzle outlet shown in FIG. 1, taken along the section line 2—2 in FIG. 1.

As shown in FIG. 1, there is an area 10 of the stretchable, flexible wall material for a container having a nozzle outlet generally indicated at 12 incorporated in the wall material and embodying the invention in a presently preferred form. This nozzle outlet 12 has a generally circular cylindrical configuration and includes an inner sleeve 14 and an outer sleeve 16. Between these sleeves is a sandwiched portion 18 of the wall material 10 which is stretched over the inner sleeve.

A bore 20 of the inner sleeve defines the outlet passage and has a portion 22 of the wall material 10 extending across the outlet passage 20. This wall material portion 22 closes and protects the outer end of the outlet passage 20 until a user desired to open the container.

When the user wishes to remove the contents of the container, the user can conveniently puncture or rupture this wall material portion 22 to allow the contents of the container to flow out through the outlet passage 20. If the user wishes to reclose the container, a standard bottle cap or similar cap can be screwed onto the external threads 24 which may be provided on the exterior surface of the outer sleeve 16.

Figure 3:
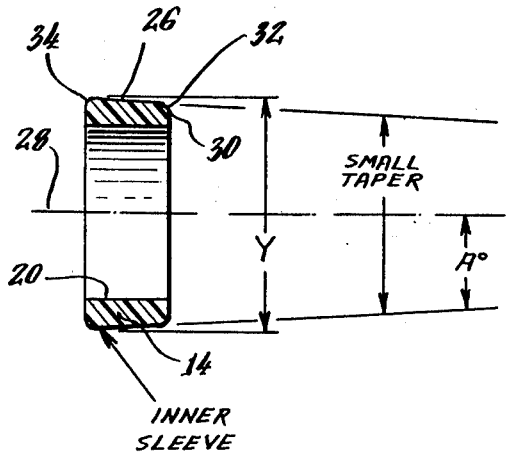
FIG. 3 is an enlarged cross-sectional view of an inner sleeve used to make the nozzle outlet of FIGS. 1 and 2. This inner sleeve has a conical exterior surface which tapers at a small angle toward one end of this inner sleeve.

As shown in the enlarged sectional view in FIG. 3, the inner sleeve has an exterior conical surface 26 which tapers at a small angle of A° to the axis 28 of the inner sleeve. This conical surface 26 converges toward the first end 30 (the small end) of this inner sleeve. The two exterior edges of this inner sleeve are relieved by rounding them with a small curvature, as seen in FIG. 3. These rounded exterior edges are indicated by the reference numbers 32 and 34. The purpose of rounding at 32 and 34 is to avoid unduly sharp edges and it is not critical as to shape.

Figure 4:
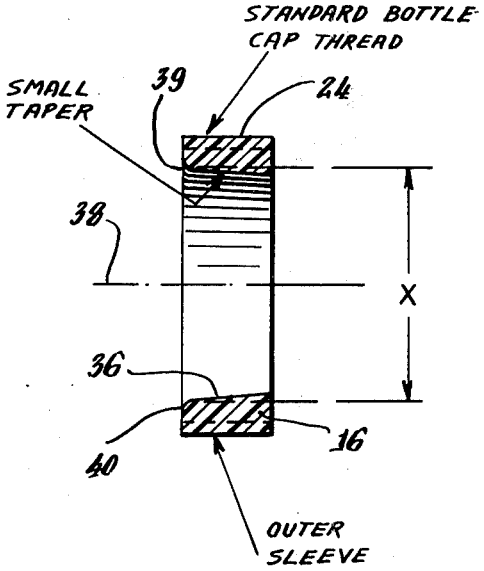
FIG. 4 is an enlarged cross-sectional view of an outer sleeve used to make the nozzle outlet of FIGS. 1 and 2. This outer sleeve has an interior conical surface which tapers toward one end of this outer sleeve.

As shown in FIG. 4, the outer sleeve 16 has an interior conical surface 36 which tapers at a small angle to the axis 38 of the outer sleeve 16. This conical interior surface 36 diverges at a small angle to the axis 38 toward a first end 40 (the large end) of the outer sleeve 16. Also, the inner edge at the first end 40 of the outer sleeve 16 is relieved or rounded by a small curvature as shown at 39. The purpose of this rounding 39 is to avoid unduly sharp edges and it is not critical as to shape.

The conical convergent exterior tapered surface 26 of the inner ring and the conical divergent interior tapered surface 36 of the outer ring have the same angle of taper, so that these two sleeves can be mated together in a wedgingly-locking relationship with a stretched portion of container wall sandwiched between them. Thus, the average internal diameter (I.D.) "X" of the tapered interior surface 36 slightly exceeds by a small differential the average outer diameter (O.D.) "Y" of the exterior tapered surface 26. This same differential is approximately equal to twice the thickness of the stretched wall material 18.

When the outer sleeve is forced over the inner sleeve around which is stretched the portion 18 of the wall material, the result is that the two mating sleeves become firmly locked together in a wedging locking relationship such that an average human being using his bare hands is unable to separate them when exerting all of his strength. Thus, a strong permanent nozzle outlet is conveniently provided in the stretchable, flexible wall material 10 at a relatively small expense.

The stretched portion of the wall material 18 is thinned out as a result of being stretched over the inner sleeve 14. It is among the advantages of this nozzle outlet 12 that the wedging-locking relationship between the two sleeves firmly sandwiches the stretched wall material between them and thereby strengthens (supports) this stretched material 18. Also, these two taper interlocked sleeves protect this stretched wall material 18 against damage during handling of the container.

The wall 10 is protected against inadvertent rupture by the rounded area 39 on the outer sleeve and also by the rounded areas 32 and 34 of the inner sleeve.

Figure 5:
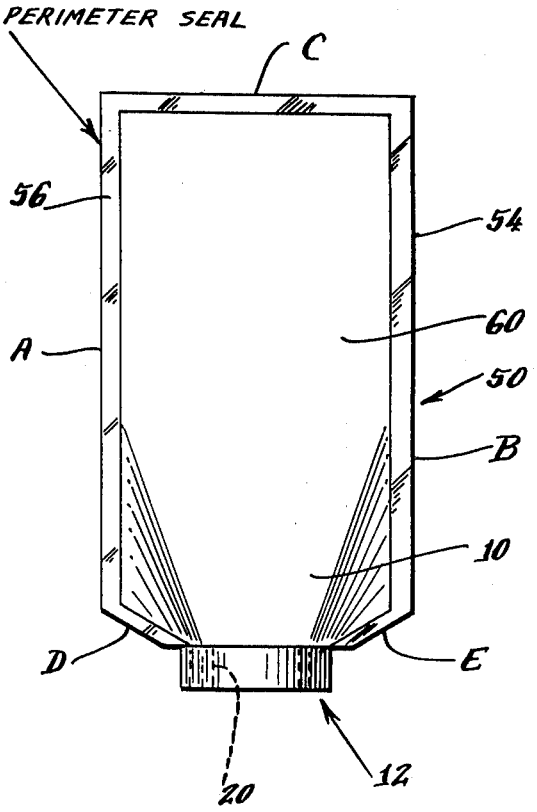
FIG. 5 is an elevational view of a container including the nozzle outlet of FIG. 1.
Figure 6:
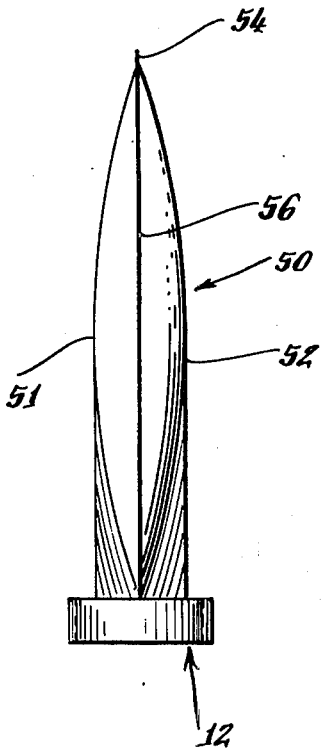
FIG. 6 is a side elevational view of the container shown in FIG. 5.

As seen in FIG. 5, the container 50 can be fabricated including the nozzle outlet 12. This container is shown in the general form of a flexible bag, being known in the packaging industry as a "fin seal package", but it is to be understood that the stretchable, flexible wall material 10 can be utilized to form other shapes of containers, for example such as those known in the packaging industry as a tubular "pillow package" or a "tetrahedral" package or a "pouch" package or any other package or bag made out of stretchable flexible packaging material. Moreover, this wall material 10 can be utilized as a portion of a container, the remainder of which is constructed of other material or materials.

In order to form the container 50, the wall material 10 is folded up on opposite sides 51 and 52, so that the edges of this wall material are brought together to form a perimeter 54 having side edges "A" and "B" and an end edge "C". Then, the opposite sides 51 and 52 of the wall material 10 are sealed together, for example by heat sealing, along a sealed region 56 extending along adjacent to the perimeter 54.

In order to fill the bag container 50, any two of the edges A, B, or C can be sealed together before filling, thus leaving the third edge open as a fill opening. After filling, this third edge is sealed for completely closing the container 50. In the container as illustratively shown in FIG. 5, the container includes sloping shoulders D and E located near the nozzle outlet 12. It is to be understood that such a container can be made either with or without such sloping shoulders.

As described above, the nozzle outlet 12 was formed in the wall material 10 before the container 50 was made, and the nozzle outlet is shown located in a folded-over edge region of the resulting container. It is to be understood that the nozzle outlet 12 can be located in any facet of the container. For example, this nozzle outlet can be located anywhere in the side panel area 60 of the container.

Also, the container 50 can be partially sealed up, and then the nozzle outlet 12 can be formed in a panel wall area 60 by working through the unsealed open edge A, B, or C. Thereafter the bag is filled, and the remaining unsealed edge is closed by sealing it.

A circular cross-sectional shape is shown for the nozzle outlet 12 and for the outlet passage 20, for this is the most commonly used configuration. It is to be understood that this nozzle outlet and its outlet passage may have a regular polygonal shape, for example such as a square, pentagon, hexagon, or octagon with rounded corners; also, an elongated cross-sectional configuration such as a rectangular shape with rounded corners.

The stretchable, flexible wall material 10 may be any material capable of being stretched and flexed simultaneously in two directions. For example, this wall material 10 may be stretchable plastic film such as polyethylene of either high or low density; polypropylene; polyvinyl chloride; a coextrusion of polyethylene and "Saran" material in which a layer of the "Saran" material is sandwiched between two layers of polyethylene, such coextrusion being obtainable commercially under the trademark "SARANEX" from Dow Chemical Company of Midland, Mich.

I have successfully formed the nozzle outlet 12 in stretchable, flexible wall material having a thickness in the range from 4 mils up to 15 mils. The small angle of taper which I have successfully used lies in the range from approximately 2° to approximately 3.5° as measured relative to the axis, thus providing a total included angle in the range from approximately 4° to 7°. If the total included angle is too large, then a wedging-locking relationship is not obtained. If the total included angle is too small, then it becomes difficult to slide the outer sleeve over the stretched wall material portion 18.

The inner and outer sleeves can be made from any rigid plastic material, for example, such as polyamid, e.g. "Nylon", polyester or a fluorinated hydrocarbon, e.g. "Teflon", or of metal, for example, such as stainless steel, aluminum, anodized aluminum. One sleeve can be made of one material, while the other sleeve may be made of yet another material.

I claim:

1. A method of forming a nozzle outlet in the stretchable, flexible wall portion of a container, said wall portion being entirely of stretchable, flexible material comprising the steps of:

providing rigid inner and outer sleeves, said inner sleeve having a passage extending therethrough, providing an exterior conical surface on said inner sleeve tapering at a small angle and converging toward a first end of the inner sleeve, providing an interior conical surface on said outer sleeve tapering at a corresponding angle to said exterior conical surface and diverging toward a first end of this outer sleeve, stretching the stretchable, flexible wall portion around the first end of the inner sleeve by forcing the first end of the outer sleeve over the first end of the inner sleeve in telescoping relationship with said wall portion therebetween, and firmly locking the two sleeves together with said outer sleeve over said inner sleeve in taper-interlocked relationship with the stretched wall portion sandwiched therebetween, whereby said permanently taper-interlocked sleeves with the stretched plastic wall portion form a permanent nozzle outlet in the wall portion.

2. A method of forming a permanent nozzle outlet in the wall of a flexible bag having its wall formed entirely from stretchable, flexible plastic film material comprising the steps of:

providing rigid inner and outer sleeves adapted to mate together in taper-interlocked relationship with a portion of the plastic film wall material stretched around the inner sleeve and sandwiched between the mated sleeves, said inner sleeve having an exterior surface which tapers at a small angle and which converges toward a first end of this inner sleeve, the outer sleeve having an interior surface which tapers at a corresponding angle and which diverges toward a first end of this outer sleeve, stretching a portion of said plastic film wall material around the first end of the inner sleeve until said first end of the inner sleeve with said stretched wall material therearound protrudes a sufficient distance beyond the surrounding wall material to form a nozzle, mating said outer sleeve over said inner sleeve in taper-interlocked relationship therewith with said stretched plastic film wall material sandwiched therebetween and with said first end of the outer sleeve adjacent to said surrounding wall material for permanently holding said sleeves in place, forming the surrounding wall material into a flexible bag container, and sealing the surrounding wall material along a perimeter of the flexible bag for completion of the container, whereby said permanently taper-interlocked sleeves with the stretched plastic film wall therebetween form a permanent nozzle outlet in the wall of the flexible bag.

* * * * *